United States Patent [19]

Boettcher

[11] Patent Number: 4,475,055

[45] Date of Patent: Oct. 2, 1984

[54] SPARK GAP DEVICE FOR PRECISE SWITCHING

[75] Inventor: Gordon E. Boettcher, Albuquerque, N. Mex.

[73] Assignee: The United States of America as represented by the United States Department of Energy, Washington, D.C.

[21] Appl. No.: 343,614

[22] Filed: Jan. 28, 1982

[51] Int. Cl.[3] ..... H01J 17/32; H01J 17/04

[52] U.S. Cl. ..... 313/54; 313/632; 313/633

[58] Field of Search ..... 313/632, 633, 54, 631

[56] References Cited

U.S. PATENT DOCUMENTS

| | | | |
|---|---|---|---|
| 2,449,397 | 9/1948 | Lamphere | 313/573 X |
| 2,478,119 | 8/1949 | Mitchel | 313/573 |
| 2,874,319 | 2/1959 | Anton | 313/54 |
| 3,230,410 | 1/1966 | Hafkemeyer, Jr. | 313/54 X |

FOREIGN PATENT DOCUMENTS

| | | | |
|---|---|---|---|
| 2511087 | 9/1976 | Fed. Rep. of Germany | 313/54 |
| 853192 | 11/1960 | United Kingdom | 313/54 |

*Primary Examiner*—Palmer C. Demeo

*Attorney, Agent, or Firm*—George H. Libman; Albert Sopp; Michael F. Esposito

[57] ABSTRACT

A spark gap device for precise switching of an energy storage capacitor into an exploding bridge wire load is disclosed. Niobium electrodes having a melting point of 2,415 degrees centrigrade are spaced apart by an insulating cylinder to define a spark gap. The electrodes are supported by conductive end caps which, together with the insulating cylinder, form a hermetically sealed chamber filled with an inert, ionizable gas, such as pure xenon. A quantity of solid radioactive carbon-14 within the chamber adjacent the spark gap serves as a radiation stabilizer. The sides of the electrodes and the inner wall of the insulating cylinder are spaced apart a sufficient distance to prevent unwanted breakdown initiation. A conductive sleeve may envelop the outside of the insulating member from the midpoint of the spark gap to the cap adjacent the cathode. The outer metallic surfaces of the device may be coated with a hydrogen-impermeable coating to lengthen the shelf life and operating life of the device. The device breaks down at about 1,700 volts for input voltage rates up to 570 volts/millisecond and allows peak discharge currents of up to 3,000 amperes from a 0.3 microfarad energy storage capacitor for more than 1,000 operations.

8 Claims, 3 Drawing Figures

SPARK GAP DEVICE FOR PRECISE SWITCHING

The U.S. Government has rights in this invention pursuant to Contract Number DE-AC04-76DP00789 between the U.S. Department of Energy and the Western Electric Company. (41 CFR §9-9.109-6(i)(5)(ii) (b)).

BACKGROUND OF THE INVENTION

The present invention relates to the field of overvoltage protection devices, and more particularly, to a gas filled spark gap device which switches high current from a charged capacitor into an exploding bridge wire detonator at a precise breakdown voltage.

In the art of high voltage, high current circuit applications, spark devices are known to protect circuit components, such as an energy storage capacitor, from voltage overloads, and to switch current from charged capacitors into output loads at various breakdown voltages. The overvoltage gap devices are required to remain inactive until breakdown voltage conditions are reached, to switch the high voltage, high current electrical surges rapidly, and to return to normal quickly after the breakdown condition has passed in readiness for subsequent operations.

Certain problems arise in the operation of spark gap devices described in the prior art. For example, in U.S. Pat. No. 2,990,492 of Wellinger et al, a gas-filled spark gap device is disclosed that is generally operable to provide overload protection, but has an undesirable short life span. It has been found in practice, the metal electrodes may erode during extended operation and cause a metallic deposit to form on ceramic insulator surfaces rendering them conductive thereby significantly reducing the overall lifetime of the device. Furthermore, to assist in ionizing the spark gap at a stable breakdown voltage level, a radioactive gas, krypton-85, is employed. The radioactive gas may leak and cause an undesirable release of radioactivity into the environment.

In U.S. Pat. no. 3,317,777 of Algar et al, a high pressure mixture of xenon and nitrogen is used for a gas-filled spark gap device. During high energy electrical discharge, nitrogen is a reactive gas and causes undesirable deterioration of the spark gap electrodes. Copper electrodes are employed. The melting point of copper is a relatively low 1,083° C.

The structure of a voltage switching device for a high voltage, high current application, as described, is subject to and thus must withstand electrode temperatures in excess of 2,000° C. in many instances. Prior art electrodes, such as shown in Algar et al, are thus incapable of withstanding this temperature without serious erosion, and this fact greatly reduces the efficiency of the device.

In the spark gap device disclosed by Kawiecki in U.S. Pat. No. 3,588,576, the electrodes defining the spark gap are made from a nickel and cobalt alloy. The nickel-cobalt alloy electrodes melt in the range of approximately 1,450–1,500° C. and thus are also generally ineffective. Inside the spark gap device, conductive strips are connected to the electrodes and extend along the inner wall of the ceramic spacer to a location opposite the electrode gap. The strips serve to stabilize operating characteristics and speed response time. Being inside the device, however, the stabilizing strips are subjected to deteriorating conditions during device discharge.

Spark gap devices are often encapsulated in organic materials for protection. However, during aging on the shelf, organic materials may emit hydrogen gas which is able to permeate through nickel, copper, nickel-cobalt alloys into the sealed chamber and change the fill gas purity.

SUMMARY OF THE INVENTION

Accordingly, it is a primary object of the present invention to provide a spark gap device having electrodes that prevent melting or serious erosion under high voltage and high current discharge conditions.

Another object of the invention is to provide a spark gap device having an inert fill gas further minimizing erosion of components during discharge conditions.

Another object is to provide a non-gaseous, stable, inert, and easily applied radioactive material for promoting spark gap discharge stability at preselected voltage levels without the danger of release of radioactive gases to the atmosphere, without added chemical impurities to the gap, or without compromising the gap's fill gas purity.

Another object of the invention is to provide a spark gap device precluding hydrogen gas permeation into the hermetically sealed chamber thereby preventing changes in fill gas composition and further maintaining high efficiency of operation.

Still another object of the invention is to stabilize discharge characteristics of the spark gap device without employing stabilizer placed inside the device being subjected to deteriorating discharge conditions.

Additional objects, advantages and novel features of the invention will be set forth in part in the description that follows and in part will become apparent to those who are skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the invention as described herein, an improved spark gap apparatus is provided for precise switching of high currents from charged capacitors, and for protecting circuitry and circuit components, such as an energy storage capacitor, from overvoltage surges. The invention includes the novel approach of providing a pair of electrodes having a melting point greater than 2,000° C. forming the spark gap. The electrodes comprise the anode and cathode and are preferably fabricated of niobium (Nb). The electrodes are supported by conductive caps spaced apart from one another by an insulating member. The caps and the insulating member form a hermetically sealed chamber filled with an inert, ionizable gas, preferably pure xenon (Xe). The electrodes are preferably made from pure niobium metal having a melting point of 2,415° C.

Further, in accordance with the invention, the spark gap device includes a quantity of solid radioactive stabilizer placed within the hermetically sealed chamber adjacent to the spark gap. The preferred solid stabilizer is a radioactive carbon-14 ($^{14}C$) composition.

In accordance with another aspect of the invention, a conductive sleeve may envelop the outside of the insulating member from the midpoint of the spark gap to the cap adjacent the cathode. The sleeve is connected to the cathode by an electrical conductor. With this arrangement, the sleeve serves to minimize the high electric field stress points by flattening the equipotential lines at the cathode side of the spark gap during operation of the device. The sleeve significantly improves the spark gap's voltage breakdown stability. Preferably, the conductive sleeve is made from a metallic material.

Further in accordance with the invention, the distance from the sides of the anode and cathode to the inner wall of the insulating member is sufficient to prevent high field local gas ionization or gas ionization development by electron avalanche along the inner surface of the insulating member thereby preventing unwanted breakdown initiation.

In accordance with yet another aspect of the present invention, the metal surface of the spark gap device may be coated with a non-permeable coating. Preferably the coating is an alloy of lead and tin, or gold. The coating prevents hydrogen permeation into the gas filled chamber of the device, and its switching stability is not impaired.

The hermetically sealed chamber is preferably filled with pure xenon gas; and a quantity of solid carbon-14 is placed within the chamber to serve as a radioactive stabilizer. The spark gap device according to the best mode is capable of switching at 1,700 volts for input voltage rates up to 570 volts per millisecond allowing peak discharge currents of up to 3,000 amperes from a 0.3 microfarad energy storage capacitor for more than 1,000 operations.

Still other objects of the present invention will become readily apparent to those skilled in this art from the following description wherein there is shown and described a preferred embodiment of this invention, simply by way of illustration of one of the best modes contemplated for carrying out the invention. As it will be realized, the invention is capable of different embodiments, and its several details are capable of modifications in various, obvious aspects all without departing from the invention. Accordingly, this art from the following description wherein there is shown and described a preferred embodiment of this invention, simply by way of illustration of one of the best modes contemplaced for carrying out the invention. As it will be realized, the invention is capable of different embodiments, and its several details are capable of modifications in various, obvious aspects all without departing from the invention. Accordingly, the drawings and the descriptions will be regarded as illustrative in nature and not as restrictive.

BRIEF DESCRIPTION OF THE DRAWINGS

The accompanying drawings incorporated in and forming a part of the specification, illustrate several aspects of the invention and together with the descriptions serve to explain the principle of the invention. In the drawings.

DETAILED DESCRIPTION OF THE INVENTION

Figure 1:
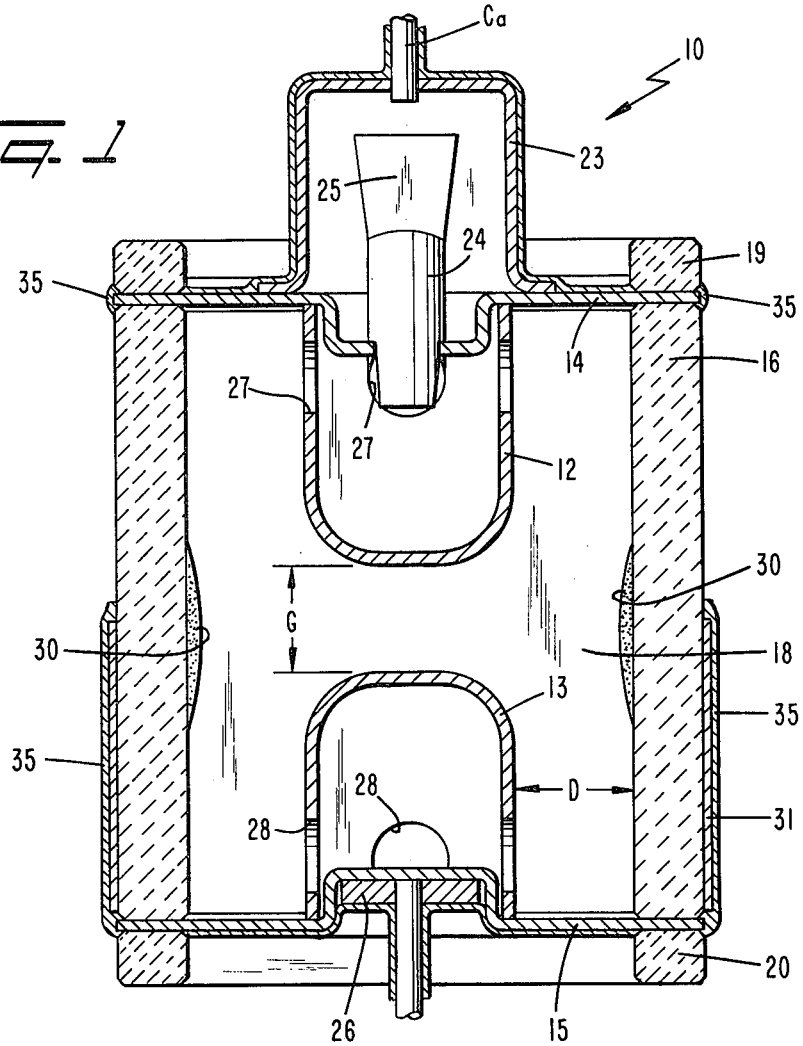
FIG. 1 is a longitudinal cross-sectional view illustrating the spark gap device of the invention.

Reference is now made to FIG. 1 showing an improved spark gap device 10 according to the invention. First conductive electrode or anode 12 and second conductive electrode or cathode 13 are made from niobium (Nb) metal having a melting point of 2,415° C. Electrodes 12 and 13 are attached or bonded to first conductive cap 14 and second conductive cap 15, respectively. Caps 14 and 15 are spaced apart from one another by an insulating member, such as ceramic cylinder 16, to define a spark gap G between electrodes 12 and 13. The end caps 14 and 15 and the cylinder 16 together form a chamber 18 which is evacuated and filled with pure xenon (Xe) gas.

Ceramic back-up rings 19 and 20 are bonded to end caps 14 and 15 respectively to provide minimum stress ceramic to metal seal. Electrode (anode) 12 is attached to first cap 14 to provide effective electrical contact. Conductive cup 23 is bonded to first cap 14 and is connected to conductor $C_a$ connected to the circuit in which the spark gap device 1 is employed (See FIG. 3). Electrode (cathode) 13 is attached to second cap 15 connected to conductor $C_b$ in the protected circuit. Conductor $C_b$ is in sealed contact with second cap 15 with sealing ring 26.

Evacuation of chamber 18 is accomplished by connecting a vacuum source (not shown) to exhaust tube 24 extending through first cap 14 into chamber 18. After exhaustion of atmospheric gases and their replacement with the fill gas xenon, chamber 18 is sealed by pinching off the end of exhaust tube 24 to form exhaust pinch off section 25.

Anode 12 and cathode 13 are dome-like structures and are provided with exahust holes 27 and 28, respectively, to prevent air pockets from being retained and to allow filling the space within the anode and cathode with xenon fill gas.

With the invention, preferably the sides of anode 12 and cathode 13 are spaced a distance D from the inner wall of cylinder 16. The distance D is selected to be sufficient to prevent high field local gas ionization or gas ionization development by electron avalanche growth along the inner surface of cylinder 16 and thus prevent unwanted breakdown initiation.

In accordance with another aspect of the invention, a quantity of solid radioactive stabilizer 30, preferably carbon-14 ($^{14}C$) is placed within the chamber 18 upon the inner wall of cylinder 16 adjacent to the spark gap G. Carbon-14 is inert and has a 5,600 year half-life. During use inside the device, Carbon-14 thus remains stable and does not contaminate the fill gas and is not plated onto the anode 12 or the cathode 13 surfaces.

In summary of the best mode presently contemplated of the invention, the anode 12 and the cathode 13 are made from high melting point material such as niobium, melting point 2,415° C. The electrodes are spaced apart by the insulating cylinder 16 made from a good insulating material, such as alumina thus defining the spark gap G. The chamber 18 is filled with xenon gas which is subjected to the ionization influence of carbon-14 stabilizer material 30. The best mode spark gap device 1 has the capability of switching at 1,700 volts for input voltage rise rates up to 570 volts/millisecond and allowing peak discharge currents of up to 3,000 amperes from a 0.3 microfarad energy storage capacitor for more than 1,000 operations.

Figure 2:
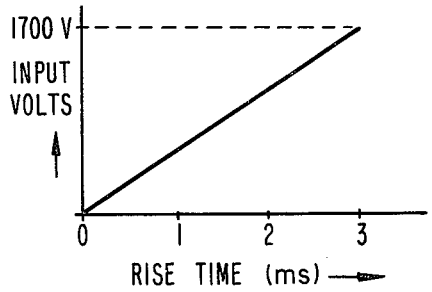
FIG. 2 is a graph illustrating the voltage response of the preferred embodiment of the invention.

In FIG. 2, the input voltage to rise time relationship of the best mode of the invention is depicted. It is noted that in a period of 3 milliseconds, the input voltage may rise up to 1,700 volts with the invention. This corresponds to a rate of rise of input voltage to time approximately equal to 570 volts/millisecond.

Figure 3:
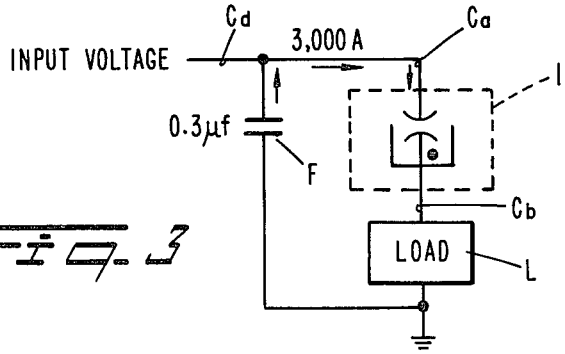
FIG. 3 is a schematic diagram illustrating the employment of the spark gap device of the invention for switching an energy storage capacitor into an exploding bridge wire load.

In FIG. 3, the spark gap device 1 of the invention is illustrated in a circuit application to provide a switching and discharge capability of 3,000 amperes from a 0.3 microfarad energy storage capacitor into an exploding bridge wire load. The input voltage is provided through conductor $C_d$ coupled to the capacitor F. The discharge device is connected to load L through conductor $C_b$.

In a further aspect of the invention, in accordance with its objects and purposes, conductive sleeve 31 envelops the outside of the cylinder 16 from the midpoint of the spark gap G to the second cap 15 adjacent the cathode 13. Sleeve 31 is electrically connected to the second cap 15, and thereby to the cathode 13 by metal coating 35 to be described in detail below. In this way, sleeve 31 serves to minimize high electric field stress points by flattening the equipotential lines at the cathode side of the spark gap G to improve voltage breakdown stability.

In fabricating spark gap device D of the invention, preferably ultra-clean parts are prepared; and a 600° C. complete assembly bake-out under vacuum pumping conditions at $10^{-8}$ Torr or less is conducted. Ultra clean xenon fill gas is added, and a cold weld copper pinch-off provides a final seal. This procedure is in sharp contrast to prior procedures which employ a lower bake-out temperature and weaker vacuum under conditions of less cleanliness. In addition, prior methods for spark gap preparation use a brazed gas seal providing less control over seal quality, gas purity, and leak tightness of the finished device.

By suitable selection of the spark gap G and xenon fill gas pressure, in conjunction with carbon-14 radiation stabilizer 30, the preferred spark gap device 10 of the invention has been optimized for breakdown voltage stability at 1,700 volts. Thus, the prior art techniques for adjusting voltage breakdown characteristics, such as using electrode elongation after gas filling, or screening and sorting finally assembled devices are not necessary.

In accordance with another aspect of the invention, it has been discovered that a metal coating 35 (shown in FIG. 1) for the outer surface of the metal surfaces of the spark gap device 10 precludes hydrogen permeation into the chamber 18. A preferred coating 35 for the device 10 is an alloy of lead and tin, or gold.

In summary, numerous benefits have been described which result from employing the concepts of the invention. With the invention, high melting point niobium electrodes 12 and 13 forestall electrode erosion even under severe voltage and current discharge conditions. By employing pure xenon gas, and solid carbon-14 radiation stabilizer 30 in the spark gap device, it is unnecessary to employ radioactive gases or chemically plated radioactive sources to promote ionization. By spacing anode 12 and cathode 13 a suitable distance D away from the inner wall of insulating cylinder 16, prevention of high field local gas ionization or gas ionization development by electron avalanche growth along the inner surface of cylinder 16 is accomplished. By selection of a suitspark gap G in conjunction with pure xenon fill gas and carbon-14 radiation stabilizer material 30, a spark gap device 10 is obtained which is capable of switching at 1,700 volts ±10% for input voltage rates up to 570 volts/millisecond and allowing peak discharge currents up to 3,000 amperes from a 0.3 microfarad energy storage capacitor for more than 1,000 operations.

An additional benefit results when a conductive sleeve 31 envelops the outside of the insulating cylinder 16 and is electrically connected to the cathode 13. With this arrangement, high electric field stress points at the cathode side of the spark gap G are minimized due to flattening of the equipotential lines and improved voltage stability results.

By employing a coating of lead and tin alloy, or gold, on the outer metal surfaces of the spark gap device 10 of the invention, permeation of hydrogen during aging on the shelf is prevented.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A spark gap device for precise switching comprising:

first and second conductive electrodes defining an anode and a cathode, each electrode having a melting point greater than approximately 2,000 degrees;

conductive caps supporting said electrodes;

an insulating member separating said conductive caps to define a spark gap, said caps and said insulating member forming a hermetically sealed chamber; and a conductive sleeve enveloping the outside of said insulating member from the midpoint of the spark gap to the cap adjacent the cathode, said sleeve being electrically connected to said cathode, thereby minimizing high electric field stress points by flattening the equipotential lines at the cathode side of said spark gap for improved voltage stability.

2. A spark gap device as described in claim 1, further comprising hydrogen-impermeable coating over all metallic outer surfaces of the device.

3. A spark gap device as described in claim 2 wherein said coating comprises either gold or an alloy of lead and tin.

4. The spark gap device as described in claim 1 wherein said chamber contains an inert, ionizable gas.

5. The spark gap device as described in claim 4 wherein said inert gas consists of xenon.

6. The spark gap device as described in claim 1 further comprising a quantity of solid radioactive stabilizer affixed to said insulating member adjacent the spark gap.

7. The spark gap device as described in claim 6 wherein said radioactive stabilizer is Carbon-14.

8. The spark gap device as described in claim 1 wherein said electrodes are made of Niobium.

* * * * *